United States Patent [19]

Maudal et al.

[11] Patent Number: 4,648,567

[45] Date of Patent: Mar. 10, 1987

[54] DIRECTIONAL CONTROL OF ROCKETS USING ELASTIC DEFORMATION OF STRUCTURAL MEMBERS

[75] Inventors: Inge Maudal, Claremont; John F. Moss, El Toro, both of Calif.

[73] Assignee: General Dynamics, Pomona Division, Pomona, Calif.

[21] Appl. No.: 634,620

[22] Filed: Jul. 26, 1984

Related U.S. Application Data

[60] Continuation of Ser. No. 477,085, Apr. 28, 1983, abandoned, which is a continuation of Ser. No. 279,891, Jul. 2, 1981, abandoned, which is a division of Ser. No. 104,496, Dec. 17, 1979, abandoned.

[51] Int. Cl.[4] ..... F42B 15/02

[52] U.S. Cl. ..... 244/3.24; 244/3.21

[58] Field of Search ..... 244/3.21, 3.24–3.3; 102/386, 388, 489

[56] References Cited

U.S. PATENT DOCUMENTS

| | | | |
|---|---|---|---|
| 1,166,879 | 1/1916 | Alard | 244/3.29 |
| 2,020,759 | 11/1935 | Atwood | 244/90 |
| 2,952,207 | 9/1960 | Kamimoto . | |
| 3,125,313 | 3/1964 | Soderberg | 244/3.21 |

*Primary Examiner*—Harold J. Tudor

*Attorney, Agent, or Firm*—Henry M. Bissell; Edward B. Johnson

[57] ABSTRACT

A missile is disclosed which utilizes elastic deformation of structural members in order to control missile flight. The elastic deformation may be in the mounting of the rocket nozzle, the provision of deformable control surfaces, or provision of deformable sections of rocket body, all of which are controlled by independent actuating means.

8 Claims, 13 Drawing Figures

DIRECTIONAL CONTROL OF ROCKETS USING ELASTIC DEFORMATION OF STRUCTURAL MEMBERS

This is a continuation of application Ser. No. 477,085, filed Apr. 28, 1983, now abandoned, which is a continuation of Ser. No. 279,891, filed July 2, 1981, now abandoned which itself is a division of Ser. No. 104,496, filed Dec. 17, 1979, now abandoned.

BACKGROUND OF THE INVENTION

1. Field of the Invention

The present invention relates to rocket and missile control systems and, more particularly, to a control system utilizing elastic deformation of portions of a rocket structure to control direction, rotation, speed, and other flight characteristics.

2. Description of the Prior Art

Many systems have been defined and described in the prior art to control and direct missile flight. U.S. Pat. Nos. 3,081,703 to Kamp et al and 3,710,715 to Hoofnagle disclose essentially skirt-like projections from the ends of projectiles to stabilize the projectile during flight. U.S. Pat. Nos. 3,785,567 to Fisher and 3,933,310 to Hickox disclose jet engine and rocket exhaust structures, respectively, which can be directed in order to control gas flow.

Another step taken to provide for the directing of exhaust gases in rockets and jet engines is the provision of flexible tubing as an integral part of the exit nozzle. The exit nozzle is then provided with means to position it, and thus direct exhaust gas flow. Such a system is disclosed, for example, in German Pat. No. 1,080,862 and in U.S. Pat. No. 3,759,447 to Weigmann.

Also, the art contains numerous references to the flexing of an actual nozzle structure in order to control the thrust direction; for example, see U.S. Pat. Nos. 2,546,293 to Berliner, 3,182,452 to Eldred, 3,258,915 to Goldberg, and 3,860,134 to Kobalter. These references utilize flexible sealing means, elastomeric materials and nozzle deformation to effect the directing of the exhaust gases. Further, the art often utilizes other controlling devices and assemblies, and other complex gas directing system. However, all of these systems are bulky, they require special sealing means, and, when dealing with rocket engines, they present the significance problem of the need of an elastomer to withstand the heat, pressure and abrasion which occurs during propulsion of the rocket.

The art has also suggested the use of control surfaces which are hinged on the surface of the projectile. The hinges are perpendicular to the longitudinal axis of the projectile, and the resulting control surfaces project outwardly from the relatively cylindrical surfaces of the projectile. Exemplary systems of this nature are found in U.S. Pat. Nos. 412,670 to Ross, 1,181,203 to Alard, and 3,007,411 to Piper et al. These systems are generally spring loaded, or otherwise hinged in some form so that after release and during flight, they provide a stabilizing effect on a projectile. However, such systems are designed for smaller projectiles and are normally not adjustable as they are merely for the purpose of controlling trajectory during the short term flight of such projectiles.

Foldable or bendable elastic control surfaces such as fins have been suggested for use by the prior art, particularly where space is at a premium. Exemplary systems include those disclosed in U.S. Pat. Nos. 3,114,287 to Swain, 3,165,281 to Gohlke, and 3,374,969 to Rhodes. These systems all suffer from the drawback of not being adjustable at deployment, and the possibility that the flexible or elastometric material will not totally straighten or properly position itself after firing. Thus, significant problems could arise relating to the effective deployment of the fins or control assemblies.

In summary, this prior art provides numerous methods, all of which suffer from some disability or another, such as sealing problems and lack of flexibility in the control of the various stabilizing devices. All of these conventional structures have been previously improved upon by applicant in his U.S. Pat. No. 4,044,970 which utilizes several reaction thrust motors on tail fins to rotate with the tail panels, and steer the rocket. Typical boost phase rocket structures provide very low tail panel effectiveness, while the present systems improve such tail panel effectiveness, as well as improving aerodynamic stability after, for example, booster burnout.

SUMMARY OF THE INVENTION

In brief, systems in accordance with the present invention provide for directional control of a rocket and control of the rocket's attitude while improving its aerodynamic stability. This is effected by providing a system with one or more components which achieve such improvements without requiring the inclusion of components in the system which would increase the weight and complexity of the system. As a result the present invention does not decrease payload capacity.

In order to perform these functions, the rockets of the present invention are provided with flexible, elastic structural members, and means for bending such elastic structural members to effect improved rocket flight stability and directional control. In a first form of the present invention, the rocket is provided with the flexible elastic and deformable member as the connection between the rocket body and the nozzle; and a plurality of separate nozzle rotating devices, such as hydraulic pistons, are provided. The hydraulic pistons are independently and continuously adjustable in response to control signals received from, for example, the missile's attitude sensor or ground control sources. The elastic flexible structure lessens the amount of direct contact between the high temperature exhaust gases, and the flexible portion of the design, and allows for a high degree of rotation and continuous angular adjustment based on the outside signals.

The rockets produced in accordance with the present invention may also be provided with the normal directional control and stabilizing fins utilized in rockets. In this added embodiment, the leading edge of at least some of such fins is fixed in place and the fins are manufactured of normal structural materials, but are sufficiently flexible over their length to allow for adjusting means to be provided at the rear end. The adjusting means is continuously adjustable, and may take the form of a screw with a threaded sleeve. Adjustment is in response to a signal from an external source and causes deflection in the control surface.

In the alternative, the skin of the rocket may be provided with longitudinal sections, each of which is independently deformable and actuable to produce a smooth, continuously increasing section as one approaches the rear of the rocket. This form may be utilized with or without the normal stabilizing side fins in the rocket design, and is most particularly useful where it is desired to slow a rocket down during flight by the production of an increase in drag.

In the first embodiment, the flexible surface is utilized for directional control, as it is in the second embodiment, but the second embodiment may also be quite useful to improve stability of the rocket after launch, as may the third embodiment. This is particularly true where the fins or sections are asymmetrically operated.

The provision of the deformable material in the design of the rocket structure advantageously improves the weight characteristics and thus increases payload potential of the rockets. This improvement is occasioned by the limination of independent hinges or bearing systems to adjust the sections used for rocket control, and the elimination of some duplicate components, such as the multi-layered flexible hose type of nozzle structure. These factors are combined with the improvement that the structures are controllable during flight. Further, the bending is specifically designed to stay within the elastic deformation limits of the material in use. Thus, a simpler, lighter weight, more effective rocket may be provided.

BRIEF DESCRIPTION OF THE DRAWINGS

A better understanding of the present invention may be had from a consideration of the following detailed description, taken in conjunction with the accompanying drawings in which.

DETAILED DESCRIPTION OF THE PREFERRED EMBODIMENTS

Figure 1:
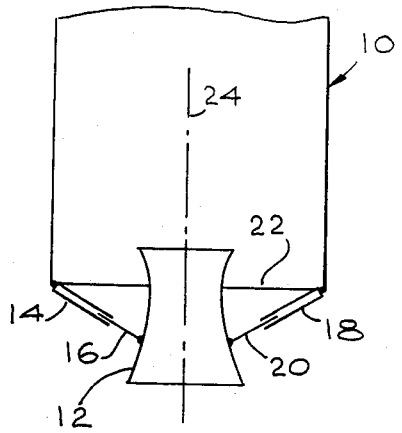
FIG. 1 is a schematic diagram of a side section of a rocket showing the basic nozzle connection structures of the present invention.
Figure 13:
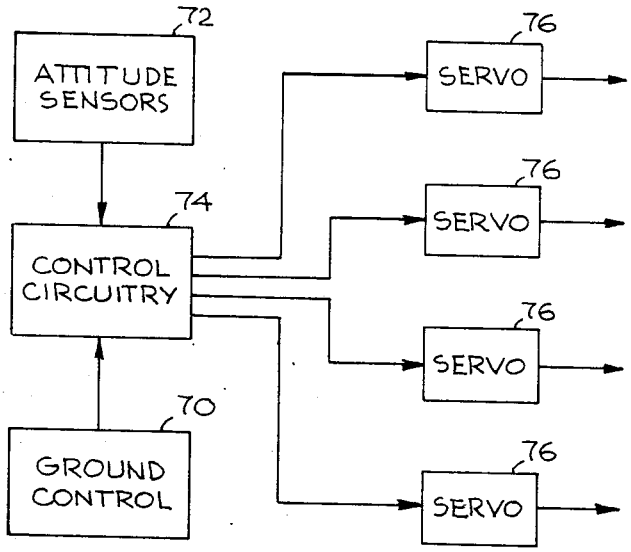
FIG. 13 is a block diagram showing control circuitry utilizable in the present invention.

In the embodiment shown in FIGS. 1 through 4, and more particularly in FIG. 1, the sectional schematic view of the rocket shows cylindrical body 10 having connected thereto rocket nozzle 12 and hydraulic cylinders 14 and 18 having piston rods 16 and 20, respectively, attached to the nozzle and effective to position the nozzle upon receipt of external signals, as shown in FIG. 13. In the embodiment shown in FIG. 1, deformable member 22 is provided between the nozzle and the main body of the rocket, and forms the seal which forces the gases produced during ignition out of nozzle 12. For straight line travel, such as during lift off, the nozzle's position is shown in FIG. 1 as having a relatively vertical center line 24 which is essentially coaxial with the center line of the rocket. Should there be a plurality of rocket nozzles, the center line of each nozzle would be parallel to the center line of the rocket.

Figure 2:
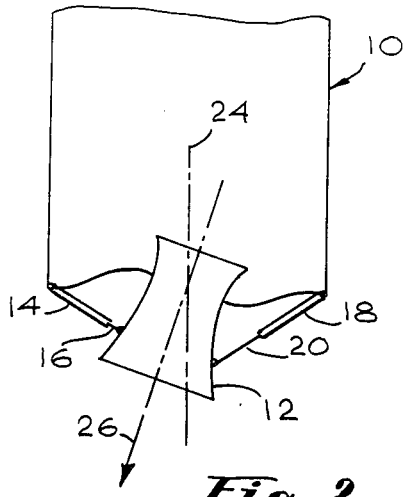
FIG. 2 shows the rocket nozzle in deformation in accordance with one embodiment of the present system.

In FIG. 2, the new center line resulting from the deformation in accordance with the present invention is shown by arrow 26. The deformation is effected by the extension of rod 20 from hydraulic cylinder 18, and the retraction of rod 16 by hydraulic cylinder 14.

Figure 3:
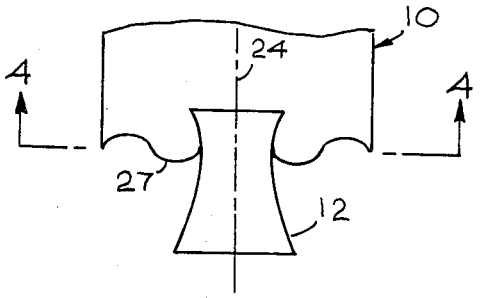
FIG. 3 shows a variation on the rocket nozzle designed in accordance with the present invention.

As shown in FIG. 3, rocket body 10 is attached to elastically deformable member 27 which, in this embodiment, has a slightly wavy or curved shape, in section, in order to increase angular deformation before reaching the elastic limit of the material. The nozzle is, in this embodiment, movable by virtue of, for example, the same hydraulic cylinder/piston arrangement shown in FIGS. 1 and 2, but for the sake of clarity these have been omitted from this figure.

Figure 4:
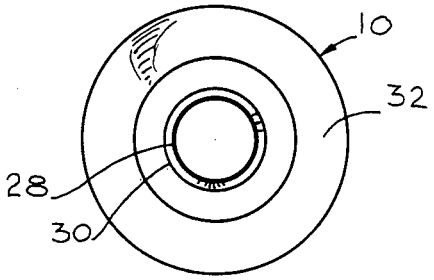
FIG. 4 is a cross sectional view taken along lines 4—4 of FIG. 3.

In FIG. 4, a section taken along lines 4—4 of FIG. 3 shows rocket body 10, nozzle 28, and the internal portion of the nozzle (shown as 30), as well as the cut-out of flexible elastic portion 32. This figure shows that the slight wave structure depicted in the side view of FIG. 3 is, in fact, circular in nature so that the nozzle may be rotated about a full 360 degree circle.

Figure 5:
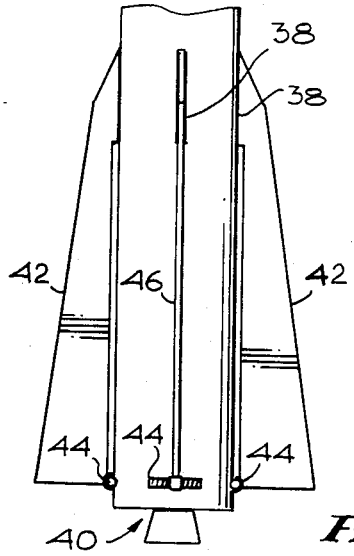
FIG. 5 is a side view showing certain external fin structure of the rocket of the present invention.
Figure 6:
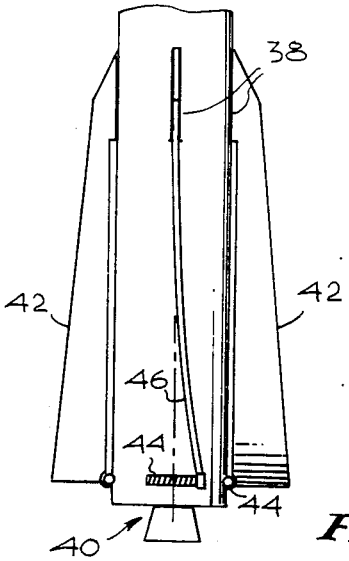
FIG. 6 shows one of the fins in full deformation.

In FIG. 5, a second control structure is shown in partial schematic form. In this particular figure, the rocket 40 is provided with fins, generally shown as 42, for stabilization and directional control. Fins 42 are rigidly attached to the rocket body at 38, and adjustably attached to the rocket by way of screws 44 at the end of the rocket. Fin 46, as shown in FIG. 5, is also shown in FIG. 6 in its deformed state wherein screw 44 has been turned in such a manner that fin 46 is displaced to the end of the screw thread and yet is still rigidly attached to rocket body 40 at point 38.

Figure 7:
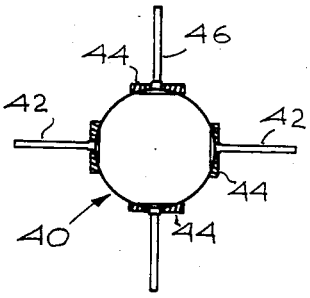
FIG. 7 shows an end view of the structure in accordance with the arrangement of FIG. 5.

In FIG. 7, an end view of the rocket shown in FIG. 5 is depicted showing fin 42 and 46 attached to screw members 44 and rocket body 40.

Figure 8:
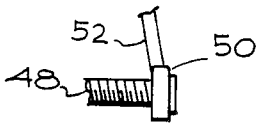
FIG. 8 shows the screw and threaded sleeve structure in full deformation as in FIG. 6.

In FIG. 8, an enlarged schematic view of the preferred threaded member and screw adjusting arrangement for this portion of the present invention is shown. In this view, shaft 48 is screw-threaded, and has threaded onto it sleeve 50. Sleeve 50 is pivotally, if needed, attached to fin 52, and thus, when shaft 48 is rotated by external means, not shown, sleeve 50 traverses the length of shaft 48, and moves to deform fin 52 appropriately.

In this format, the portion of the present invention embodied by FIGS. 5 through 8 provides both stabilizing and directional control of the rocket, by the selective incremental adjustment of any or all of screw threaded members or screw threaded shafts in response to a ground control signal, an attitude sensor signal, or the like. Thus the direction and attitude of the rocket may be adjusted and changed, as desired.

Figure 9:
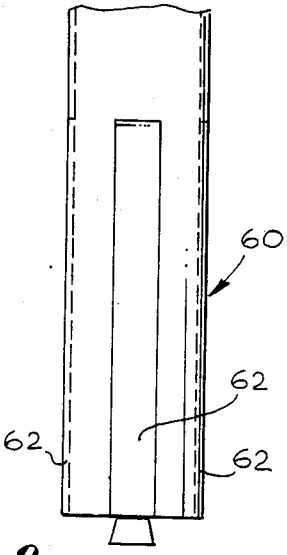
FIG. 9 is a partial schematic showing flexible drag vanes prior to deployment.
Figure 10:
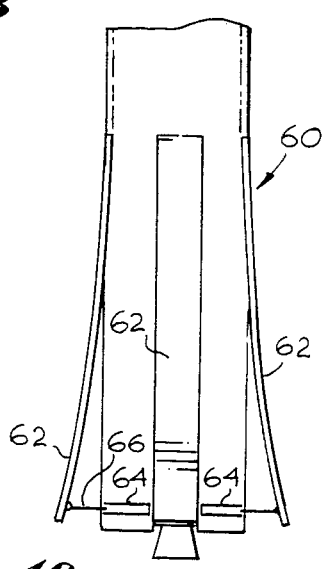
FIG. 10 shows a side view of the rocket of FIG. 9 with the drag vanes fully deployed and operational.
Figure 11:
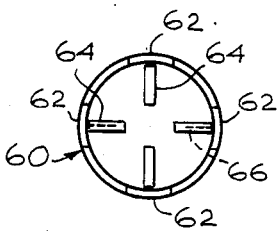
FIG. 11 is an end view of the embodiment of FIG. 9 prior to deployment.
Figure 12:
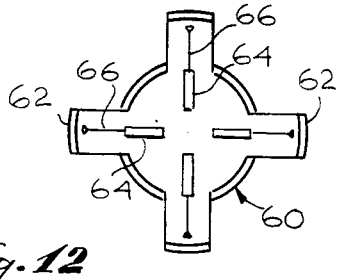
FIG. 12 is an end view of the fully deployed embodiment as shown in FIG. 10.

In FIGS. 9–12, a third preferred control system of the present invention is shown. In this form, the surface of the rocket 60 is provided with a plurality of adjustable protrusions 62 (preferably four), each of which is an integral portion of the rocket body at its upper end, but, at its lower end (closest to the rocket nozzle) is provided with hydraulic cylinder 64 and its associated piston rod 66 which are independently actuable to elastically deform the skin of the rocket, at any selected time, in an outward manner in order to, for instance, increase drag and slow the rocket during flight. Note that a differential actuation, or actuation of only one member, will provide directional control of the rocket. In FIG. 9, the deformable portions are shown in their relaxed inward position, which is also indicated in FIG. 11 (an end view of FIG. 9) in partial schematic. In FIG. 10, each elastic section is deformed outwardly to the extent possible, which is limited by the elastic characteristics of the surface material. As shown in FIG. 12, this deformation results from hydraulic cylinder 64 being actuated to push rods 66 in an outward direction in order to deform surfaces 62. It should be noted at this point that different numbers of deformable members may be utilized, that they may be actuated by other means, and that they may be actuated both individually and jointly, but they should be independently actuable and, preferably, such actuation should be relievable during flight. The sections are, at least, adjustable as in the other embodiments disclosed herein, by virtue of signals received from attitude sensors or ground control signal sources.

In the block diagram of FIG. 13, signals from ground control station 70 and from attitude sensors 72 on the rocket are both provided to control circuitry 74, which communicates with, for instance, servomotors 76. Each servomotor may be interconnected with, for instance, shaft 44 in FIGS. 5, 6 and 7 or a fluid pump to the drive hydraulic cylinders shown in FIGS. 1, 2 and 10, 11 and 12. In this manner, the control circuitry would be actuated in accordance with rocket attitude and ground control signals to actuate the appropriate servos, and adjust the rocket nozzle position, the fin positions, or the drag sections. Thus, appropriate control of the attitude, direction of travel, and/or speed of the rocket, can be effected.

The materials utilized in construction of these elastic control surfaces, in accordance with the present invention, are the same materials ordinarily used on the surface of the rocket, and this is a distinct advantage of the present invention. That is, almost all metals are, at least to a certain extent, deformable, and therefore elastic, and thus the normal state-of-the-art rocket materials may be utilized to perform the functions of the present invention. The result of this advantage is the weight decrease noted above.

Although there have been described above specific arrangements of a control system for a rocket in accordance with the invention for the purpose of illustrating the manner in which the invention may be used to advantage, it will be appreciated that the invention is not limited thereto. For example, although the invention has been disclosed in the context of association with rockets, the principles of the invention are equally applicable to long range missiles or the like. Accordingly, any and all modifications, variations or equivalent arrangements which may occur to those skilled in the art should be considered to be within the scope of the invention as defined in the appended claims.

What is claimed is:

1. A controllable missile comprising:

a cylindrical missile body including an external skin, having an outer surface encasing the missile;

main propulsion means acting along the axis of the body to propel the missile;

directional control means including a continuously elastically deformable, relatively planar structural member unitarily formed as part of said skin, thereby constituting a portion of said external skin, said member having forward and aft end portions and being separated from adjacent portions of the external skin except at the forward end thereof, whereby said member constitutes a continuous extension of the external skin at said forward end;

adjusting means coupled between said body and said structural member adjacent said aft end for selectively deforming said member substantially throughout its extent between said forward and aft ends to control the direction of said missile in flight; and means for selectively activating said adjusting means in accordance with applied signals including signals indicating missile attitude.

2. A controllable missile comprising:

a cylindrical missile body including an external skin having an outer surface;

main propulsion means acting along the axis of the body to propel the missile;

directional control means including a continuously elastically deformable, relatively planar structural member unitarily formed as part of said skin, said member having forward and aft end portions and being formed as a continuation of said skin at said forward end; said member having a continuous, uninterrupted structure throughout its extent between said forward and aft ends; said member being continuously deformable elastically along said continuous, uninterrupted structure between the forward and aft ends; and means for selectively and adjustably deforming said relatively planar structural member in accordance with applied control signals to change the attitude of the missile in flight.

3. The missile of claim 2 comprising a plurality of elastically deformable, relatively planar structural members extending longitudinally along the outer surface of the missile body and located symmetrically about said outer surface, each being unitarily formed with said external skin and constituting a continuous extension of said external skin at the forward end of the member.

4. The missile of claim 3 wherein said members comprise segments of the external skin of the missile body, said segments being generally parallel with the axis of the missile body and effective to control missile attitude by aerodynamic reaction forces when the missile is within the atmosphere.

5. The missile of claim 4 wherein each member's deforming means consists of a single hydraulic cylinder and piston actuator coupled between the missile body and a corresponding aft end of the member.

6. The missile of claim 3 wherein said members consist of portions of the missile body skin containing from; the forward ends of the members, said members being separable from the missile body along the portion extending from the forward end which is movable outwardly from the missile body surface.

7. The missile of claim 6 including means for selectively deforming elastically each of the separable portions outwardly from the missile body surface to control missile attitude while the missile is in flight within the atmosphere by selectively developing aerodynamic drag along one side of the missile axis.

8. The missile of claim 7 wherein said selectively deforming means are controllable to deform all of said separable portions simultaneously to develop aerodynamic drag when the missile is in flight within the atmosphere to slow the missile in flight.

* * * * *